US007891124B1

(12) United States Patent
Willis

(10) Patent No.: US 7,891,124 B1
(45) Date of Patent: Feb. 22, 2011

(54) PICTURE HANGER

(76) Inventor: David E. Willis, 23412 Pacific Park Dr., 21-E, Aliso Viejo, CA (US) 92656

( * ) Notice: Subject to any disclaimer, the term of this patent is extended or adjusted under 35 U.S.C. 154(b) by 0 days.

(21) Appl. No.: 12/634,912

(22) Filed: Dec. 10, 2009

(51) Int. Cl.

| | |
|---|---|
| ***A47G 1/16*** | (2006.01) |
| ***A47G 1/24*** | (2006.01) |
| ***E04B 1/38*** | (2006.01) |
| ***E04C 1/40*** | (2006.01) |
| ***E04C 5/00*** | (2006.01) |

(52) U.S. Cl. ..... 40/757; 40/759; 40/761; 40/764; 248/477; 248/489; 248/495; 248/496; 52/235; 52/506.05; 52/511; 52/512; 52/698

(58) Field of Classification Search ..... 40/757, 40/759, 761, 764; 52/235, 506.05, 511, 512, 52/698; 248/477, 495, 496, 489
See application file for complete search history.

(56) References Cited

U.S. PATENT DOCUMENTS

| | | | | |
|---|---|---|---|---|
| 2,530,892 | A | 11/1950 | Mayo | |
| 2,635,840 | A | 4/1953 | Barry | |
| D181,471 | S | 11/1957 | Heberlein | |
| 3,861,639 | A | 1/1975 | Morrill | |
| 4,083,525 | A | 4/1978 | Rath | |
| 4,228,982 | A | 10/1980 | Sellera | |
| 4,315,615 | A | 2/1982 | Scocozza | |
| D266,223 | S | 9/1982 | Swartz | |
| 4,437,639 | A | 3/1984 | Stein | |
| 4,496,128 | A | 1/1985 | Larsen | |
| 4,530,482 | A | 7/1985 | Berinson | |
| 4,568,055 | A | 2/1986 | Klitzky | |
| 4,591,125 | A | 5/1986 | Bellehumeur | |
| 4,611,780 | A | 9/1986 | Robertson | |
| 4,712,761 | A | 12/1987 | Wassell | |
| D333,085 | S | 2/1993 | Thomsen | |
| 5,249,765 | A | 10/1993 | Garcia | |
| D368,850 | S | 4/1996 | Coppedge et al. | |
| D449,976 | S | 11/2001 | Klaesi | |
| D454,481 | S | 3/2002 | DeLine | |
| 6,454,235 | B1 * | 9/2002 | O'Banion | 248/495 |
| 6,719,260 | B1 | 4/2004 | Hart | |
| 2005/0223611 | A1 * | 10/2005 | Dennis | 40/729 |

FOREIGN PATENT DOCUMENTS

| | | |
|---|---|---|
| AU | 718053 | 4/2000 |

* cited by examiner

*Primary Examiner*—Lesley Morris
*Assistant Examiner*—Syed A Islam
(74) *Attorney, Agent, or Firm*—Greenberg Traurig LLP; Franklin D. Ubell

(57) ABSTRACT

A frame hanger apparatus including a rectangular wall piece for attachment to a wall and a frame piece attachable to a picture frame. The wall piece has front and back surfaces, the front surface having a lower lip and an upper lip formed thereon. The lower lip has an arced top surface, and the upper lip has first and second elongated horizontally disposed mounting slots positioned therein. The frame piece has a lip projecting from the front surface which has an arced surface thereon. The arced top surface of the wall piece is dimensioned to dovetail with the arced surface of the lip of the frame piece and an overhanging lip on the wall piece is positioned so as to lock the wall piece and frame piece together.

4 Claims, 4 Drawing Sheets

PICTURE HANGER

FIELD

The subject disclosure relates to a picture hanging apparatus and more particularly to such an apparatus which features easy leveling of a picture frame, easy picture frame vertical edge alignment, and an easy lock feature to secure components in place once the picture is properly positioned.

RELATED ART

Various picture hanging devices are known in the art. However, each suffers from one or more drawbacks.

SUMMARY

The following is a summary description of an illustrative embodiment of an improved picture hanger apparatus providing a number of advantageous features. This summary is provided as a preface to assist those skilled in the art to more rapidly assimilate the detailed design discussion which ensues and is not intended in any way to limit the scope of the claims which are appended hereto in order to particularly point out the invention.

An illustrative embodiment of a frame hanger apparatus includes a rectangular wall piece for attachment to a wall and a frame piece attachable to a picture frame. The wall piece has front and back surfaces, the front surface having a lower lip and an upper lip formed thereon. The lower lip of the wall piece has an arced top surface, and the upper lip has an upwardly angled portion and first and second elongated horizontally disposed mounting slots positioned above the upwardly angled portion. The frame piece has a front surface and a back surface and a lip projecting from the front surface which has an arced surface thereon. The arced top surface of the wall piece is dimensioned to dovetail with the arced surface of the lip of the frame piece and an overhanging lip on the wall piece is positioned so as to lock the wall piece and frame piece together. The horizontal mounting slots facilitate moving the picture frame horizontally to left or right to align its vertical edges.

DETAILED DESCRIPTION OF ILLUSTRATIVE EMBODIMENTS

Figure 1:
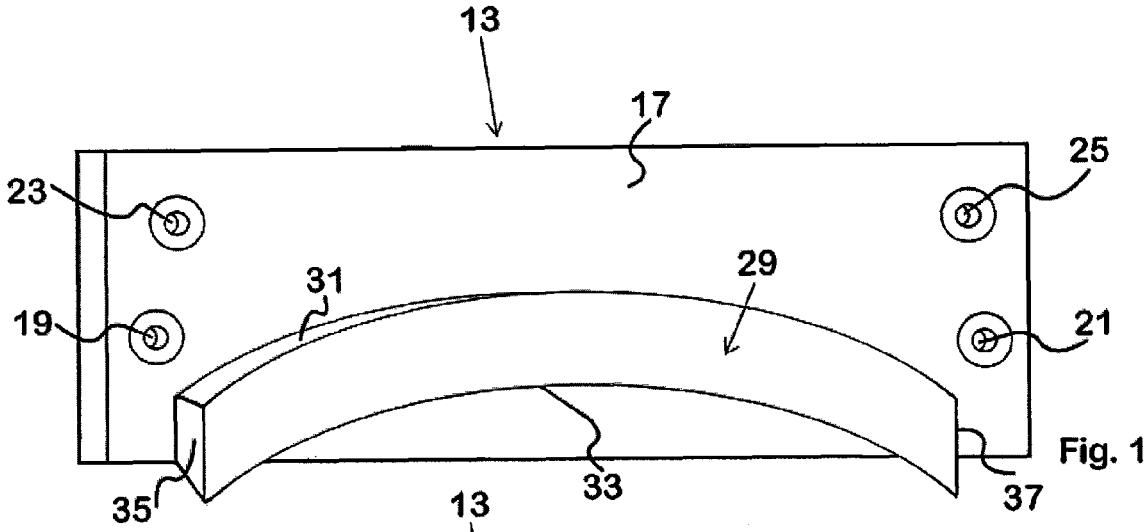
FIG. 1 is a front view of a frame piece component of an illustrative embodiment.
Figure 2:
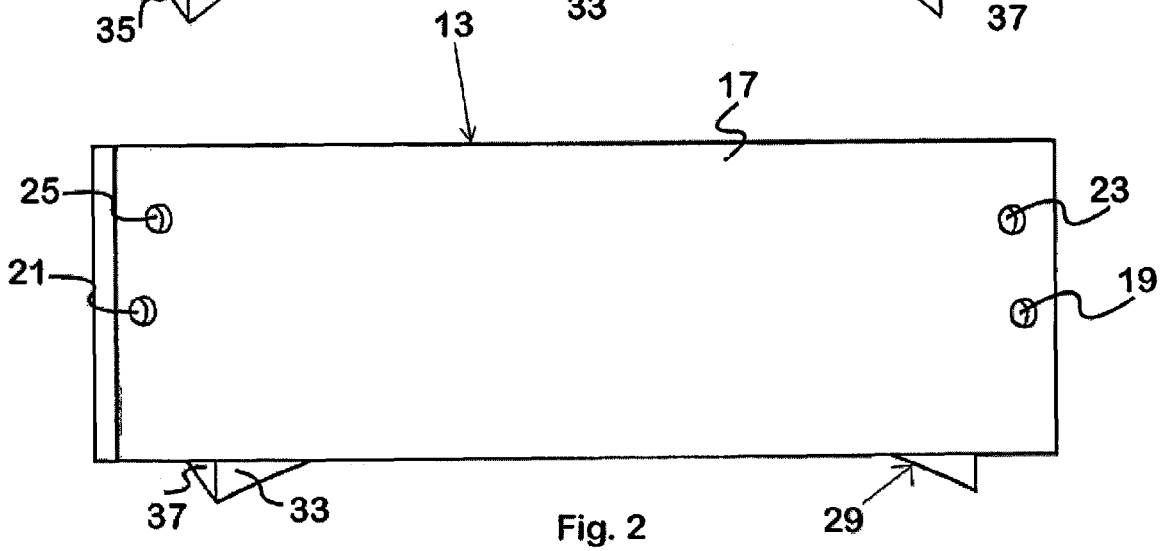
FIG. 2 is a back view of the frame piece component of FIG. 1.
Figure 3:
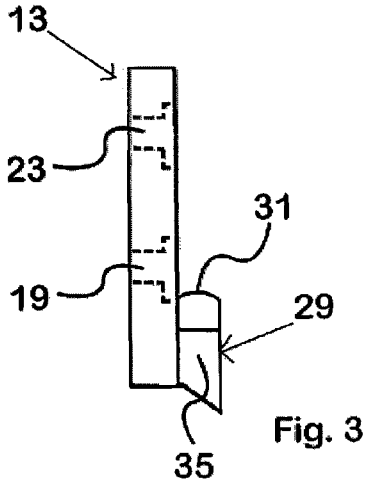
FIG. 3 is a side view of the frame piece component of FIG. 1.

An illustrative embodiment of a picture hanger is shown in FIGS. 1 to 8. The picture hanger 11 comprises two main parts—a frame piece 13 and a wall piece 15. In the illustrative embodiment, the frame piece 13 has a rectangular, flat back surface 17 and first and second pairs of mounting holes 19, 21; 23, 25. When installed, the back surface 17 of the frame piece 13 typically rests flush against the back surface of a picture frame.

As seen in FIG. 1, the rectangular front surface 27 of the frame piece 13 has a lip 29 projecting therefrom. In the illustrative embodiment, the lip 29 has arced top and bottom surfaces 31, 33. In one embodiment, the arc of the top and bottom surfaces may each be an arc of a radius "R" of 7¼". The lip 29 further terminates in respective vertical ends 35, 37, each of which is disposed near a respective one of the first pair of mounting holes 19, 21.

Figure 4:
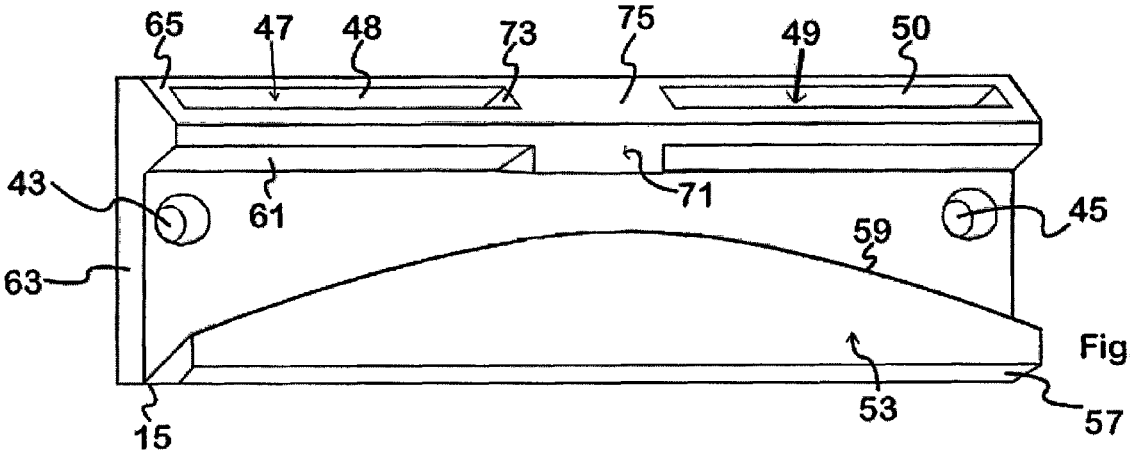
FIG. 4 is a front view of a wall piece component of the illustrative embodiment.
Figure 5:
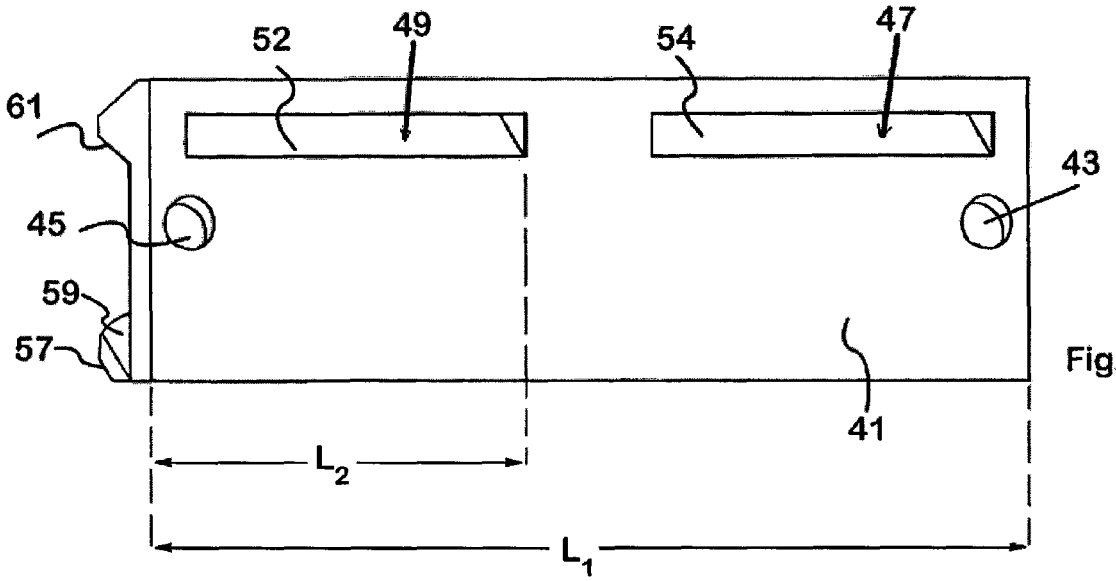
FIG. 5 is a back view of the wall piece component of FIG. 4.

As seen in FIGS. 4 and 5, the wall piece 15 has a rectangular, flat back surface 41; a pair of through holes 43, 45; and a pair of elongated, angled mounting slots 47, 49. The slots 47, 49 are rectangular in cross-section providing rectangular front openings 48, 50 and rectangular rear openings 52, 54.

The front surface of the wall piece 15 has a rectangular perimeter 51, a lower lip 53 at the bottom thereof, and an upper lip 55 at the top thereof. When installed, the back 41 of the wall piece 15 typically rests flush against a wall on which a picture is to be hung.

The lower lip 53 of the wall piece 15 has a flat bottom edge 57, which is flush with the perimeter 51 of the wall piece 15. The top edge 59 of the lower lip 53 is curved in an arc which is shaped to dovetail or mate with the arc of the bottom surface 33 of the frame piece 13. In an illustrative embodiment, the arc of the top edge 59 may be circular of a radius $R_1$ of 7¼".

Figure 6:
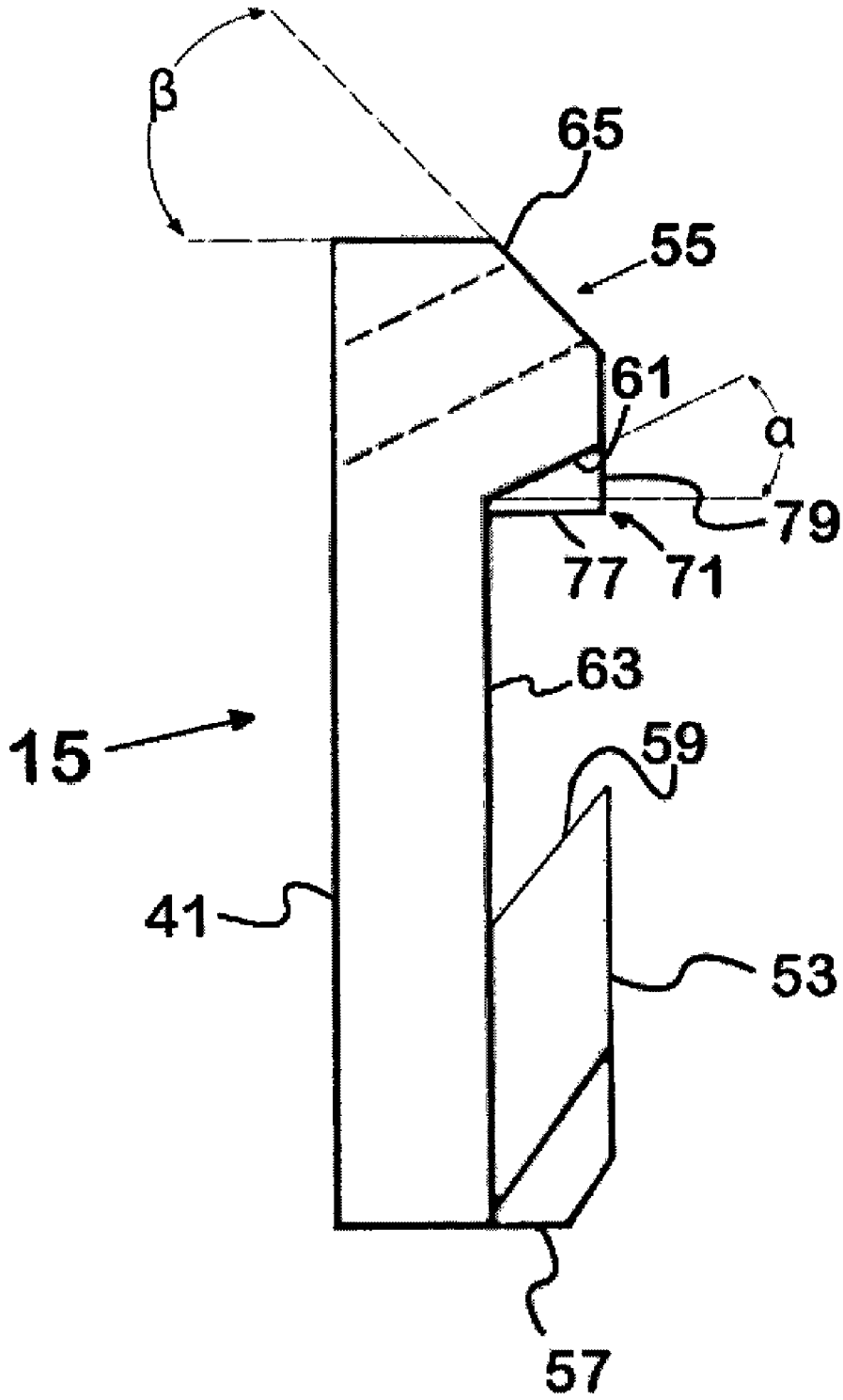
FIG. 6 is an end view of the wall piece components of FIG. 4.

As seen in FIG. 6, the upper lip 55 of the wall piece 15 has a bottom surface 61, which is flat and angled upwardly at an angle $\alpha$ with respect to the horizontal. The upper lip 55 further has a top surface 65 which, is angled downwardly at an angle $\beta$ with respect to the horizontal.

In one illustrative embodiment the angles $\alpha$ and $\beta$ may each be 45 degrees. In this embodiment, the mounting slots 47, 49 are angled downwards from the front surface 63 to the back surface 41 of the wall piece 15. These slots 47, 49 are elongated horizontally to assist in positioning a picture. In one embodiment, where the length "$L_1$" of the wall piece 15 is four inches, each slot 47, 49 is 1½ inches in length "$L_2$." In this embodiment, the height of the wall piece is one inch and the thickness ¼".

In the illustrative embodiment, the upper lip 65 of the wall piece further has an overhanging lip 71 projecting therefrom and centrally positioned between the respective inner ends 73, 75 of the elongated slots 47, 49. The overhanging lip 71 has a flat bottom surface 77, which meets at a right angle with vertical surface 63 and a flat front surface 79, which meets at a right angle with the flat bottom surface 77.

In one embodiment the wall piece 15 and frame piece 13 are each a single piece plastic injection molded component, although they could each be fabricated of more than one part and of materials other than plastic, for example, such as stamped metal.

The frame piece 13 may be attached to the back of a picture frame, for example, with two wood screws (e.g. 2×⅜ flat head brass). The wall piece 15 may be attached to the wall, for example, with two nails (e.g. 16×1½ flat head wire nails) hammered through the center of each separate slot 47, 49 in the top of the wall piece 15.

Figure 7:
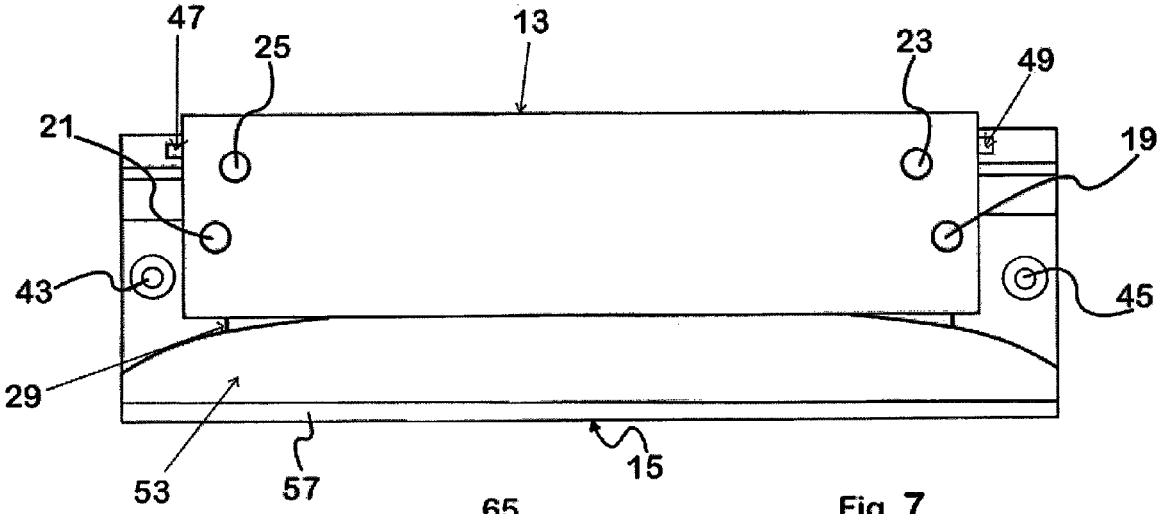
FIG. 7 is a front view of the frame and wall pieces assembled together.
Figure 8:
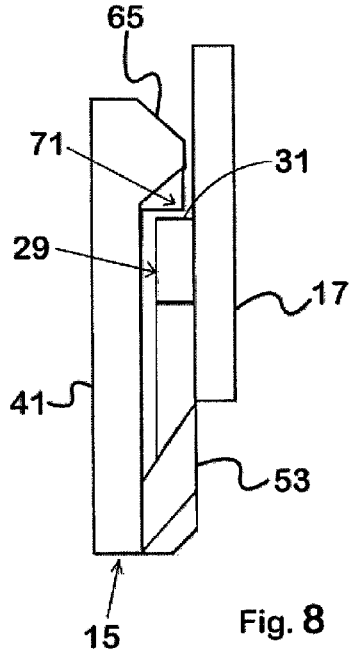
FIG. 8 is an end view of the frame and wall pieces assembled together.

Once the pieces 13, 15 are in place, the picture is held up to the wall at an angle (approx. 20 degrees to either side) in order to slide the curved surface 33 of the frame piece 13 into the matching curved surface 59 of the wall piece 15. The opposing dovetailed curves will slide into place in mating relation as the picture is rotated to an upright and level position. The flat, overhanging lip 71 at the center/top of the wall piece 15 is positioned close enough to the top surface 31 of the frame piece lip 29 that it serves to lock the two pieces 13, 15 together, holding the picture firmly against the wall. The picture can now be adjusted along the horizontal axis, to the left or to the right, by moving the entire structure along the two nails inserted through the slots 47, 49 on the wall piece 15. This adjustment is limited to approximately 1" in either direction and permits aligning the vertical edges of a picture, either in relation to the wall, or in relation to other pictures on the wall. The resulting inter-fitting relationship is illustrated in FIGS. 7 and 8.

Various embodiments may achieve the following advantages:

1. Easy leveling due to the curved, dovetailed design
2. Easy vertical edge alignment due to the angled nail slots in the wall piece
3. Easy lock to secure everything in place once the picture is positioned.

Various embodiments thus make up for the "normal homemakers" lack of skill with a measuring tape, hammer and screwdriver. An imperfect effort can still give perfect results.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. Frame hanger apparatus comprising:

a rectangular wall piece for attachment to a wall having front and back surfaces, the front surface having a lower lip and an upper lip formed thereon, the lower lip having an arced top surface, the upper lip having an upwardly angled portion;

first and second elongated horizontally disposed mounting slots formed in the wall piece above the upwardly angled portion and extending through said wall piece and angled downwardly from the front surface to the back surface of the wall piece;

an overhanging lip projecting from the front surface of the wall piece and overhanging the arced top surface of the wall piece, the overhanging lip being centrally positioned between the first and second mounting slots; and a rectangular frame piece for attachment to a frame, the frame piece having a front surface and a back surface and a lip projecting from the front surface of the frame piece, the lip having an arced surface thereon;

wherein the arced top surface of the wall piece is dimensioned to dovetail with the arced surface of the lip of the frame piece, and wherein the overhanging lip is positioned so as to lock the wall piece and frame piece together when the frame piece is inserted into the wall piece.

2. The frame hanger apparatus of claim 1 wherein the lip on the front surface of the frame piece comprises a solid projection formed on a flat front surface of the frame piece, said projection having an arced bottom surface, parallel vertical ends and an arced top surface having the same arc as the bottom surface.

3. The frame hanger apparatus of claim 2 wherein the upper lip has a downwardly angled flat surface formed above said upwardly angled portion and wherein the first and second slots are disposed in said downwardly angled flat surface.

4. The frame hanger apparatus of claim 3 wherein the overhanging lip has a flat bottom surface which meets at a right angle with a vertical front surface of the wall piece.

* * * * *